US012098660B1

(12) United States Patent
Foster

(10) Patent No.: US 12,098,660 B1
(45) Date of Patent: Sep. 24, 2024

(54) SWITCHABLE VALVE BRIDGE

(71) Applicant: Schaeffler Technologies AG & Co. KG, Herzogenaurach (DE)

(72) Inventor: Colin Foster, Belle River (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 18/224,607

(22) Filed: Jul. 21, 2023

(51) Int. Cl.

| | |
|---|---|
| ***F01L 1/26*** | (2006.01) |
| ***F01L 1/18*** | (2006.01) |
| ***F01L 1/20*** | (2006.01) |
| ***F01L 1/46*** | (2006.01) |
| ***F01L 9/20*** | (2021.01) |
| ***F01L 13/00*** | (2006.01) |

(52) U.S. Cl.
CPC ..... *F01L 1/267* (2013.01); *F01L 1/181* (2013.01); *F01L 1/20* (2013.01); *F01L 1/462* (2013.01); *F01L 9/20* (2021.01); *F01L 13/0005* (2013.01); *F01L 2001/467* (2013.01)

(58) Field of Classification Search
CPC ..... F01L 1/267; F01L 1/12; F01L 1/18; F01L 1/181; F01L 1/20; F01L 1/26; F01L 1/462; F01L 2001/467; F01L 9/20; F01L 13/0005; F01L 2013/001
See application file for complete search history.

(56) References Cited

U.S. PATENT DOCUMENTS

| | | | | |
|---|---|---|---|---|
| 8,646,425 | B2 | 2/2014 | Methley et al. | |
| 9,631,522 | B2 | 4/2017 | Cyborski et al. | |
| 9,714,587 | B2 | 7/2017 | Cyborski et al. | |
| 9,790,824 | B2 * | 10/2017 | Baltrucki | F02D 13/04 |
| 10,612,428 | B1 | 4/2020 | Patterson et al. | |
| 10,851,682 | B2 * | 12/2020 | Baltrucki | F01L 13/06 |
| 2014/0326212 | A1 | 11/2014 | Baltrucki et al. | |
| 2021/0324769 | A1 * | 10/2021 | Gron, Jr. | F01L 1/146 |

* cited by examiner

*Primary Examiner* — Loren C Edwards

(57) ABSTRACT

A switchable valve bridge for an internal combustion engine is provided that includes an outer housing, an inner housing, a locking collar, and a first ramp. The outer housing includes two valve pallets configured to interface with two poppet valves. The inner housing is slidably disposed within the outer housing. The inner housing has a first locking latch configured to move radially relative to an actuation axis of the inner housing. The locking collar is configured to move axially via an actuation force applied to the locking collar in a first axial direction parallel to the actuation axis. The first ramp is disposed within both the first locking aperture and the locking collar. The first ramp is configured to be actuated by the locking collar such that axial movement of the first ramp causes radial movement of the first locking latch.

19 Claims, 7 Drawing Sheets

SWITCHABLE VALVE BRIDGE

TECHNICAL FIELD

The disclosure concerns a valve bridge for an internal combustion engine. More particularly, the disclosure concerns a switchable valve bridge that can be utilized for either valve deactivation or variable valve lift for an internal combustion engine.

BACKGROUND

Current valve drives of internal combustion (IC) engines utilize valve bridges that are arranged between a rocker arm and a pair of poppet valves. Deactivating the poppet valves or adjusting a lift height of the poppet valves can be beneficial for IC engine performance, efficiency, and emissions.

SUMMARY

An example embodiment of a switchable valve bridge for an internal combustion engine is provided that includes an outer housing, an inner housing, a locking collar, and a first ramp. The outer housing includes a first valve pallet configured to interface with a first poppet valve, a second valve pallet configure to interface with a second poppet valve, and a first locking aperture. The inner housing is slidably disposed within the outer housing. The inner housing has a first locking latch configured to move radially relative to an actuation axis of the inner housing. The locking collar is configured to move axially via an actuation force applied to the locking collar in a first axial direction. The first ramp can be disposed within both the first locking aperture and the locking collar. The first ramp is configured to be actuated by the locking collar such that axial movement of the first ramp causes radial movement of the first locking latch. The first ramp can be configured to directly engage the first locking latch.

In an exemplary first locked position of the switchable valve bridge, the first locking latch engages the first locking aperture so that the inner housing is locked to the outer housing. In a further aspect, the first locking latch can include a flat that is configured to engage a flat of the locking aperture.

In an exemplary second locked position of the switchable valve bridge, the first locking latch is in a radially inward position so that the inner housing is unlocked from the outer housing.

In an example embodiment, the first ramp includes a tapered interface that engages the first locking latch. In a further aspect, the tapered interface engages a curved surface of the first locking latch.

In an example embodiment, the switchable valve bridge includes a mechanical lash adjustment ring arranged between the inner housing and the outer housing. The mechanical lash adjustment ring is configured to be selectively installed to adjust an axial position of the inner housing relative to the outer housing. In a further aspect, the lash adjustment ring is selected from one of a plurality of lash adjustment ring groups to achieve a predetermined mechanical lash between the inner housing and the outer housing, and the plurality of lash adjustment ring groups are sorted according to thickness.

In an example embodiment, the switchable valve bridge can include a return spring configured to move the locking collar in a second axial direction when the actuation force is less than a force of the return spring. In a further aspect, the return spring can engage either the ramp or the locking collar.

In an example embodiment, the switchable valve bridge can include a lost motion spring arranged between the inner housing and the outer housing. In a further aspect, the lost motion spring is arranged within a bore of the outer housing such that the inner housing and the lost motion spring are arranged in series within the bore.

In an example embodiment, the inner housing includes a protrusion that extends outside of the bore of the outer housing, and the protrusion includes a rocker arm interface configured to directly engage a rocker arm.

In an example embodiment, the outer housing includes a second locking aperture, a second locking latch is configured to engage the second locking aperture in the first locked position, and a second ramp is disposed within the second locking aperture. The second ramp can be configured to directly engage the second locking latch and be actuated by the locking collar. In a further aspect, the first and second ramps are separate components.

In an example embodiment, the actuation force is not derived from a pressurized hydraulic fluid.

In an example embodiment, the locking collar is configured to be slidably guided by an outer surface of the extension.

An example embodiment of a switchable valve bridge system for an internal combustion engine includes an electrical actuator, an arm configured to be actuated by the electrical actuator, and a switchable valve bridge. The switchable valve bridge includes an outer housing: i) configured to actuate two poppet valves, and ii) having an extension that includes a locking aperture. The switchable valve bridge also includes an inner housing slidably disposed within a bore of the extension, a locking collar engaged with the arm, and a ramp disposed within the locking collar. The inner housing has a locking latch configured to movie radially relative to an actuation axis of the inner housing. The locking collar is configured to move axially via an actuation force from the arm via the electrical actuator. The ramp is configured to be actuated by the locking collar such that axial movement of the ramp causes radial movement of the locking latch from a first locked position, in which the locking latch engages the locking aperture, to a second unlocked position, in which the inner housing is unlocked from the outer housing.

In an example embodiment, the arm includes two fingers that extend on opposite sides of the outer housing and engage the locking collar.

DETAILED DESCRIPTION

Embodiments of the present disclosure are described herein. It should be appreciated that like drawing numbers appearing in different drawing views identify identical, or functionally similar, structural elements. Also, it is to be understood that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The terminology used herein is for the purpose of describing particular aspects only, and is not intended to limit the scope of the present disclosure. Unless defined otherwise, all technical and scientific terms used herein have the same meaning as commonly understood to one of ordinary skill in the art to which this disclosure belongs. Although any methods, devices or materials similar or equivalent to those described herein can be used in the practice or testing of the disclosure, the following example methods, devices, and materials are now described.

Figure 1:
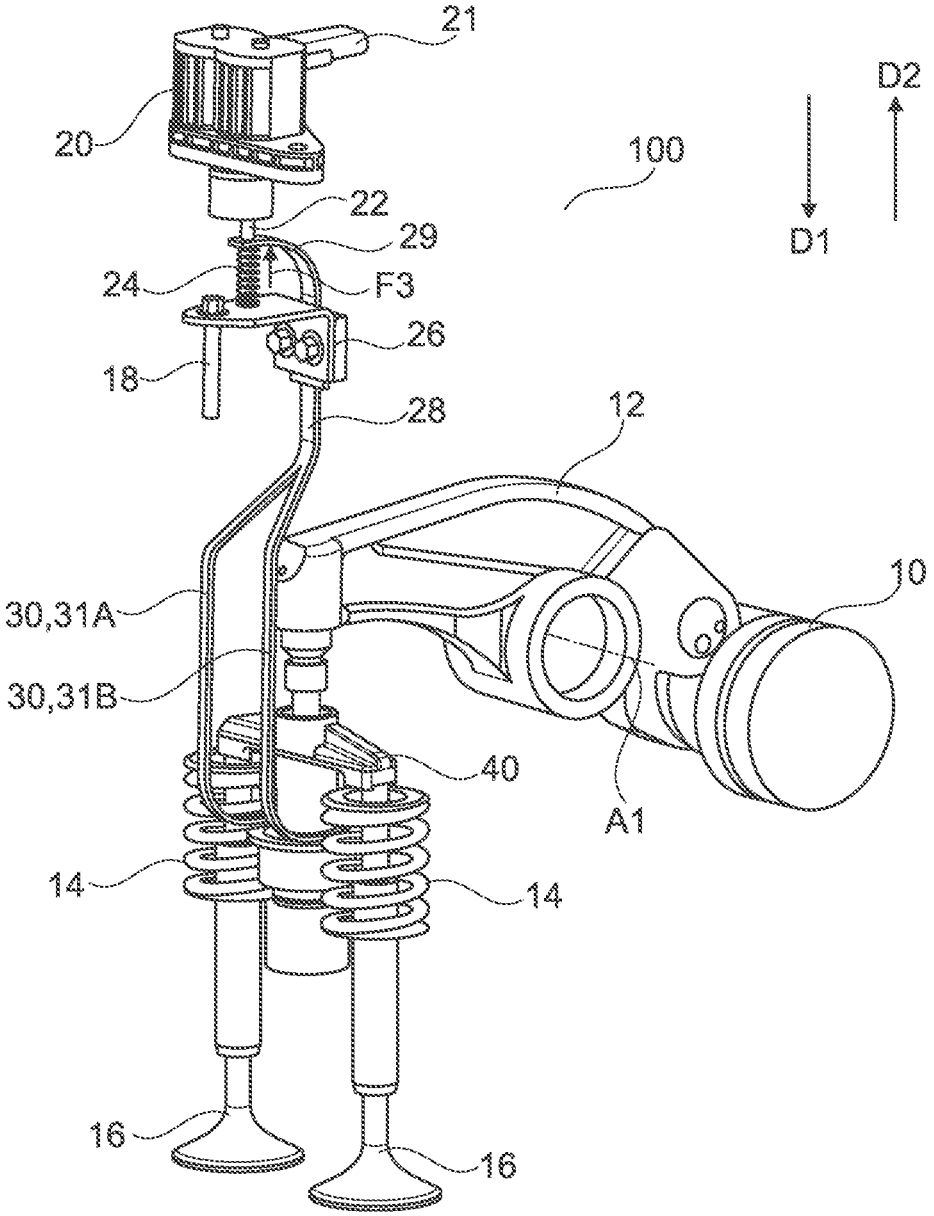
FIG. 1 is a perspective view of an example embodiment of a switchable valve train system including a switchable valve bridge.
Figure 2:
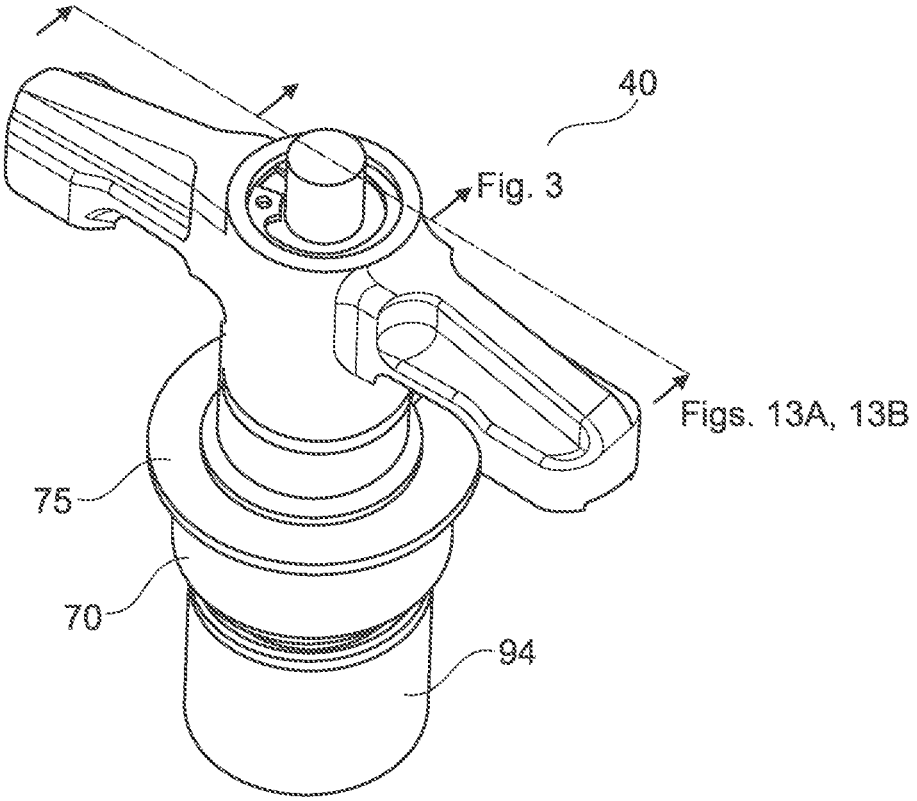
FIG. 2 is a perspective view of the switchable valve bridge of FIG. 1.
Figure 3:
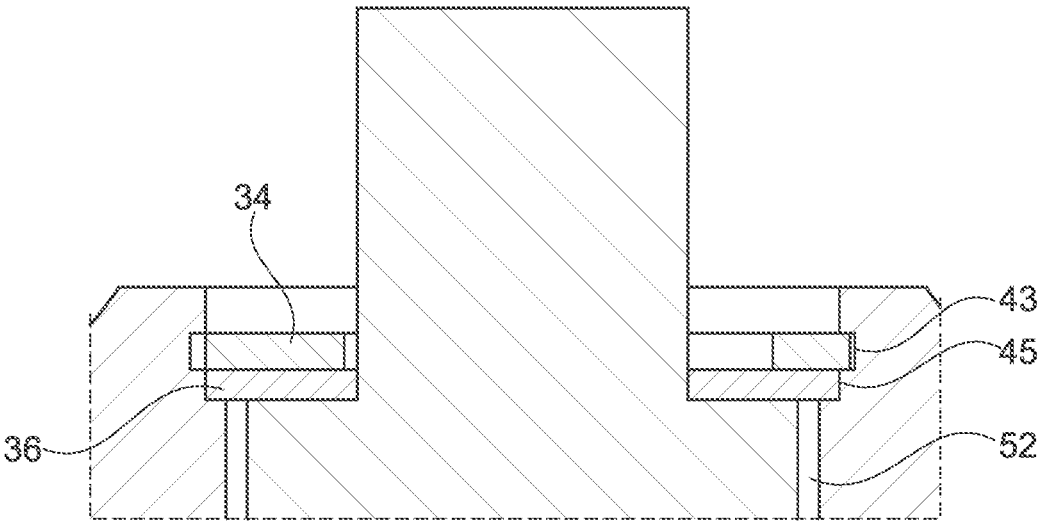
FIG. 3 is a cross-sectional view of a top portion of the switchable valve bridge taken from FIG. 2.
Figure 4:
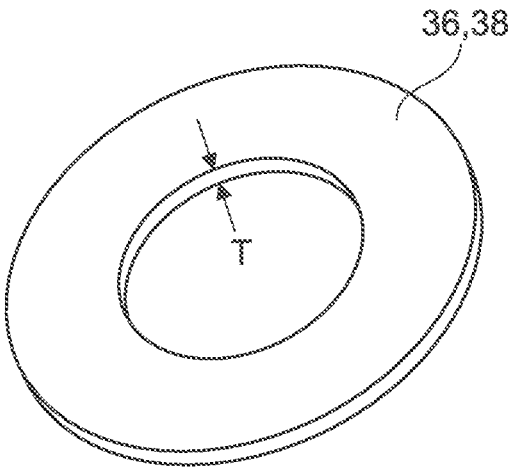
FIG. 4 is a perspective view of an example embodiment of a mechanical lash adjuster.
Figure 5:
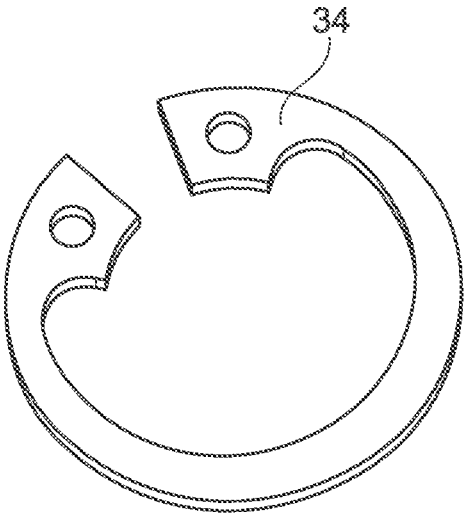
FIG. 5 is a perspective view of an example embodiment of an inner housing retaining ring.
Figure 6:
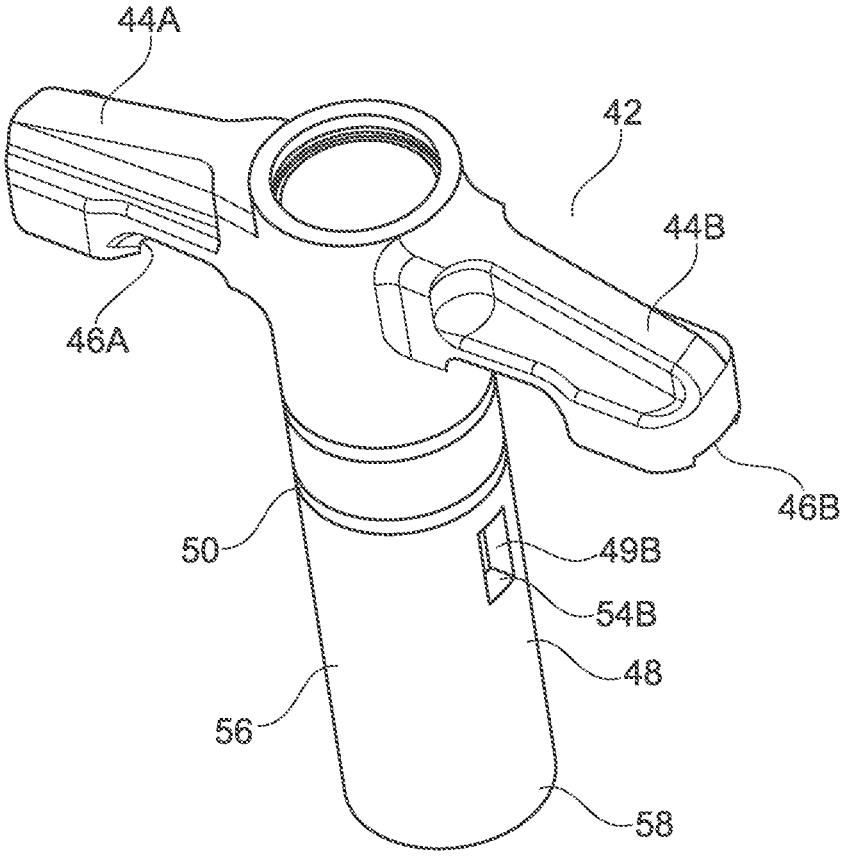
FIG. 6 is a perspective view of an example embodiment of an outer housing of the switchable valve bridge of FIG. 1.
Figure 7:
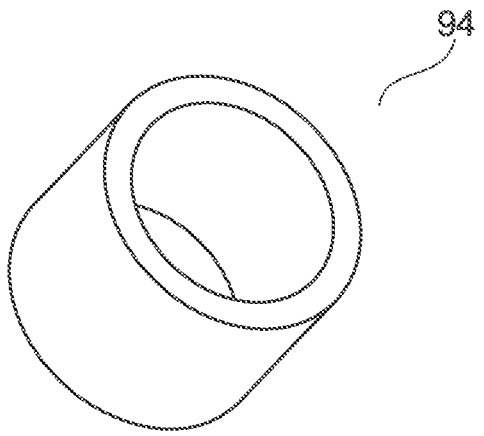
FIG. 7 is a perspective view of an example embodiment of a spring collar of the switchable valve bridge of FIG. 1.
Figure 8:
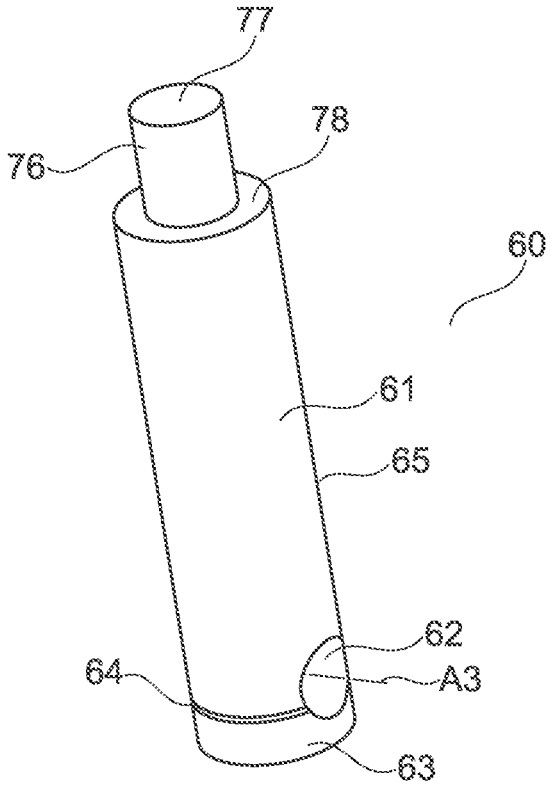
FIG. 8 is a perspective view of an example embodiment of an inner housing of the switchable valve bridge of FIG. 1.
Figure 9:
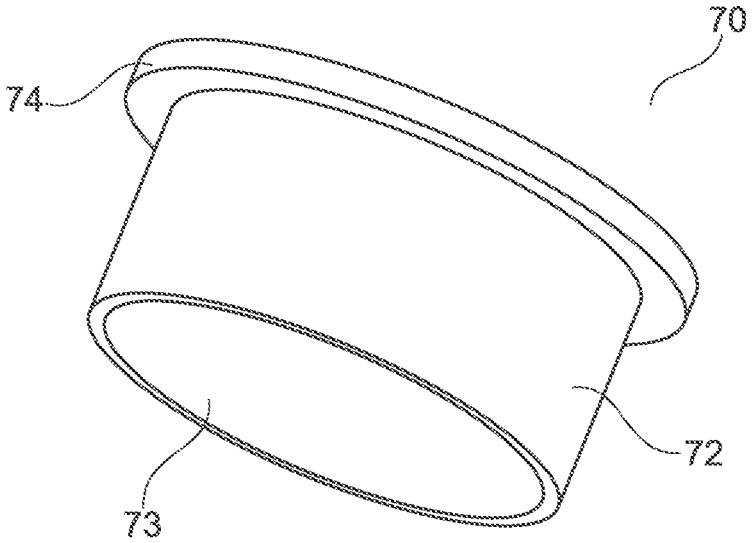
FIG. 9 is a perspective view of an example embodiment of a locking collar of the switchable valve bridge of FIG. 1.
Figure 10A:
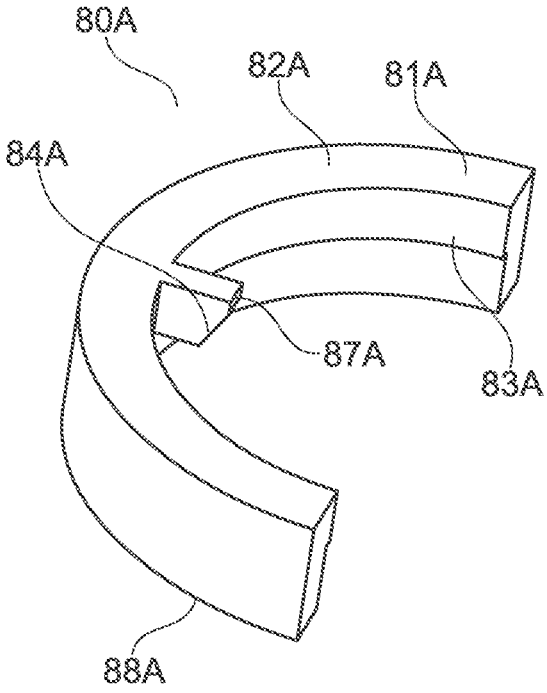
FIG. 10A is a perspective view of an example embodiment of a first ramp of the switchable valve bridge of FIG. 1.
Figure 10B:
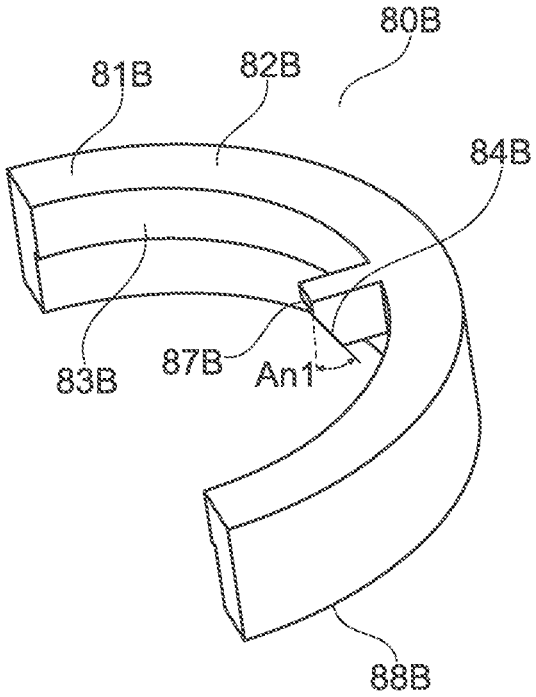
FIG. 10B is a perspective view of an example embodiment of a second ramp of the switchable valve bridge of FIG. 1.
Figure 11:
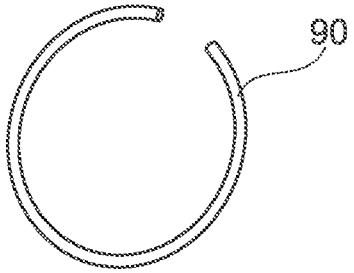
FIG. 11 is a perspective view of an example embodiment of a locking latch retention ring of the switchable valve bridge of FIG. 1.
Figure 12:
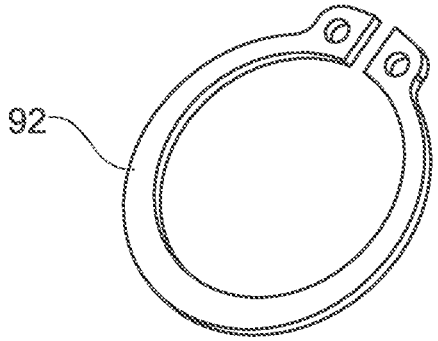
FIG. 12 is a perspective view of an example embodiment of a circlip of the switchable valve bridge of FIG. 1.
Figure 13A:
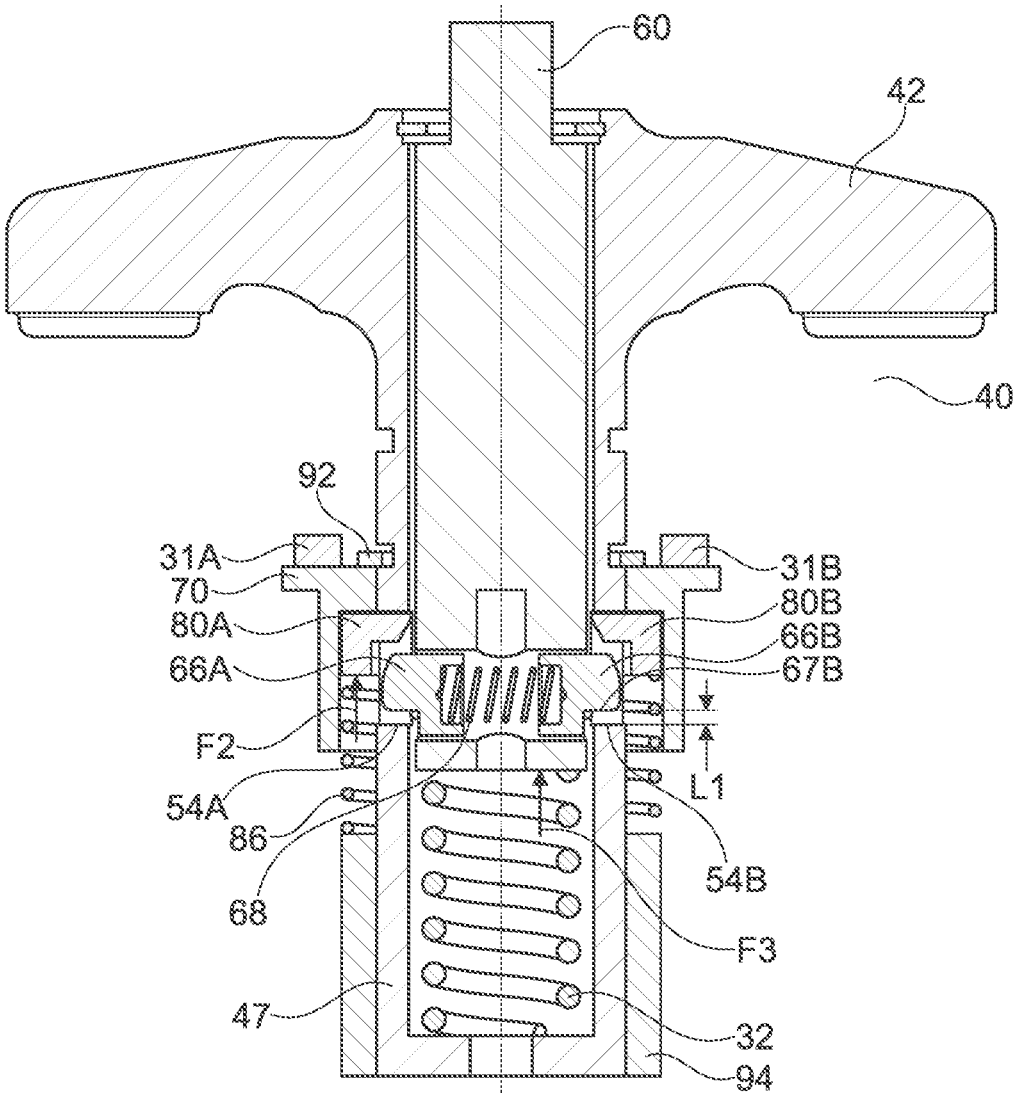
FIG. 13A is a cross-sectional view taken from FIG. 2 with the switchable valve bridge in a first locked position or first locked state.
Figure 13B:
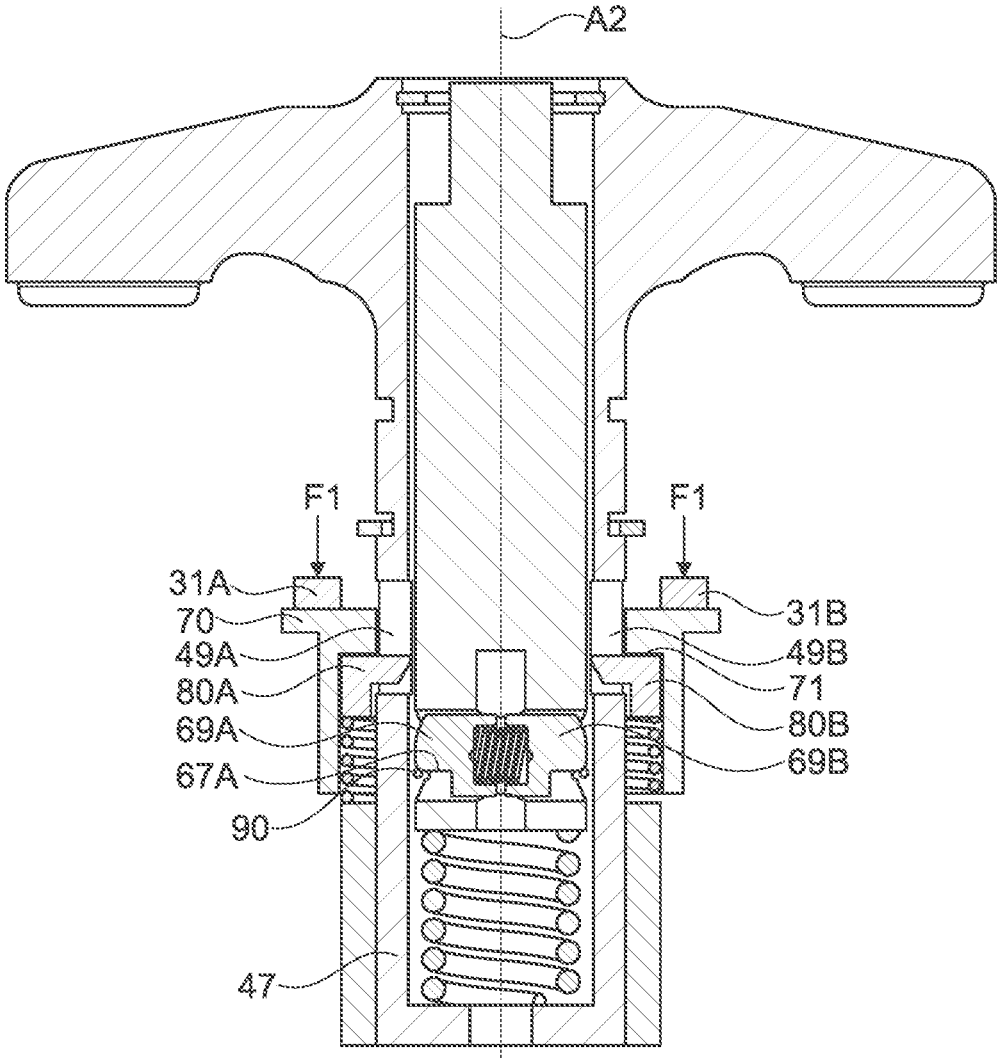
FIG. 13B is a cross-sectional view taken from FIG. 2 with the switchable valve bridge in a second unlocked position or second unlocked state.

FIG. 1 shows a perspective view of an example embodiment of a switchable valve train system 100 that includes a switchable valve bridge 40. FIG. 2 shows a perspective view of the switchable valve bridge 40. FIG. 3 shows a cross-sectional view of a top portion of the switchable valve bridge 40. FIGS. 4 and 5 show perspective views of a respective mechanical lash adjuster 38 and an inner housing retaining ring 34. FIG. 6 shows a perspective view of an outer housing 42 of the switchable valve bridge 40. FIG. 7 shows a perspective view of a spring collar 94 of the switchable valve bridge 40. FIG. 8 shows a perspective view of an inner housing 60 of the switchable valve bridge 40. FIG. 9 shows a perspective view of a locking collar 70 of the switchable valve bridge 40. FIGS. 10A and 10B show perspective views of a respective first ramp 80A and second ramp 80B of the switchable valve bridge 40. FIG. 11 shows a perspective view of a locking latch retention ring 90 of the switchable valve bridge 40. FIG. 12 shows a perspective view of a circlip 92 of the switchable valve bridge 40. FIG. 13A shows a cross-sectional view taken from FIG. 2 with the switchable valve bridge 40 in a first locked position. FIG. 13B shows a cross-sectional view taken from FIG. 2 with the switchable valve bridge 40 in a second unlocked position. The following discussion should be read in light of FIGS. 1 through 13B.

The switchable valve train system 100 includes a rocker arm 12, a camshaft 10, a switchable valve bridge 40, a pair of valve springs 14 corresponding to a pair of poppet valves 16, an actuator 20, an arm 28, and a bracket 26. The actuator 20 can be an electrical actuator that communicates electronically with a controller (not shown) via an electrical connector 21. An actuator pin 22 of the actuator 20 is engaged with a first end 29 of the arm 28. The arm 28 is slidably guided by a bracket 26 fixed via a fastener 18 to a cylinder head (not shown) of an IC engine. A second end 30 of the arm 28 is defined by a first finger 31A and a second finger 31B. The arm 28 could be described as splitting into two fingers that define the second end 30. The first and second fingers 31A, 31B engage opposite sides of the locking collar 70 of the switchable valve bridge 40.

The switchable valve bridge 40 includes the outer housing 42 which has a first arm 44A, a second arm 44B, and an extension 48. The first arm 44A includes a first valve pallet 46A that engages one of the two poppet valves 16 and the second arm 44B includes a second valve pallet 46B that engages another one of the two poppet valves 16. It could be stated that the first and second arms 44A, 44B define an opposed arrangement. The extension 48 can be described as tubular in form and extends in a direction away from the rocker arm 12, or in the first direction D1. The first and second fingers 31A, 31B of the arm 28 extend on opposite sides of the outer housing 42 of the switchable valve bridge 40, or, more specifically, extend on opposite sides of the extension 48 of the outer housing 42. Alternatively stated, the first and second fingers 31A, 31B flank the extension 48. The outer housing 42 includes a bore 52 that extends between the first arm 44A and the second arm 44B and longitudinally within the extension 48. The bore defines a cylindrical wall 47 of the extension 48. The extension 48 of the outer housing 42 includes a first locking aperture 49A and a second locking aperture 49B that extend through the wall 47 of the extension 48 formed by the bore 52. An open end of the bore 52 includes a retaining groove 43 for an inner housing retaining ring 34 and a lash step 45 for a mechanical lash adjuster 38 in the form of a mechanical lash adjustment ring 36. The inner housing retaining ring 34 is directly engaged by the mechanical lash adjustment ring 36. Any suitable number of mechanical lash adjustment rings 36 could be present.

The switchable valve bridge 40 includes the inner housing 60 which is disposed within and slidably guided by the bore 52 of the outer housing 42. The inner housing 60 has an elongated shaft portion 61 and a protrusion 76 that protrudes from the shaft portion 61. A distal end of the protrusion 76 has a rocker arm interface 77 that directly engages the rocker arm 12. The protrusion 76 and the shaft portion 61 define a stepped ring interface 78. At least a portion of the protrusion 76 extends outside of the bore 52 of the outer housing 42. The inner housing 60 can be locked and unlocked from the outer housing 42 via a first locking latch 66A and a second locking latch 66B, each engaging the respective first locking aperture 49A and the second locking aperture 49B of the outer housing 42. It may be possible to use only one locking latch instead of two. The first and second locking latches 66A, 66B can be pins, plates, balls, or any suitable shape for locking the inner housing 60 to the outer housing 42. Furthermore, the first and second locking latches 66A, 66B can include curved surfaces, flat surfaces, angled surfaces, or any suitable surface for locking the inner housing 60 to the outer housing 42.

The first and second locking latches 66A, 66B are disposed within a common locking bore 62 that extends through a locking end 63 of the shaft portion 61. Each of the first and second locking latches 66A, 66B could also be arranged within individual non-connecting bores. A return spring 68 is arranged within the locking bore 62 between the first and second locking latches 66A, 66B such that the first and second locking latches 66A, 66B are pre-loaded against the locking latch retention ring 90 which serves as an outer stop. The locking latch retention ring 90, installed in a groove 64 of the inner housing 60, engages a first flat 67A of the first locking latch 66A and a second flat 67B of the second locking latch 66B to also prevent rotation of the first and second locking latches 66A, 66B about an axis A3 of the locking bore 62.

The switchable valve bridge 40 includes the locking collar 70 which is slidably guided by an outer surface 56 of the extension 48 of the outer housing 42. The locking collar 70 includes a flange 74 and a sleeve 72. The flange 74 has an arm landing 75 (FIG. 2) configured to receive the first and second fingers 31A, 31B of the arm 28; the first and second fingers 31A, 31B engage the arm landing 75 at locations that are 180 degrees apart. The sleeve 72 includes an inner radial surface 73 that surrounds and houses the first and second ramps 80A, 80B and an upper portion of a ramp return spring 86.

In the first locked position of the switchable valve bridge 40 shown in FIG. 13A, the first and second locking latches 66A, 66B protrude radially outwardly from a radial outer surface 65 of the shaft portion 61 of the inner housing 60 so that first and second ends 69A, 69B of the respective first and second locking latches 66A, 66B engage a respective first locking surface 54A of the first locking aperture 49A and a second locking surface 54B of the second locking aperture 49B. In the first locked position, the actuator pin 22 of the actuator 20 is in a retracted position and the arm 28 is forcibly moved upward in a second direction D2 via an arm return spring 24 installed on the bracket 26 and the ramp return spring 86 engaged with the first and second ramps 80A, 80B. In this upward position of the arm 28, the locking collar 70 is pushed upward via the ramp return spring 86 until it abuts with the circlip 92 installed in a groove 50 on an extension 48 of the outer housing 42. While in the first locked position, rotary motion of the camshaft 10 is translated to linear valve lift of the poppet valves 16 via the rocker arm 12 and switchable valve bridge 40. That is, rotation of the camshaft 10 pivots the rocker arm 12 about a rocker axis A1 so that the rocker arm 12 pushes down on the poppet valves 16 in the first direction D1 so that the poppet valves 16 move or open in the first direction D1. In the first locked position, the inner housing 60 is locked to the outer housing 42 so that all of the rotary motion of the camshaft 10 is translated to linear movement of the poppet valves 16 via the rocker arm 12 and the switchable valve bridge 40.

In the second unlocked position of the switchable valve bridge 40 shown in FIG. 13B, the first and second locking latches 66A, 66B are pushed or moved radially inwardly by the respective first and second ramps 80A, 80B to unlock the inner housing 60 from the outer housing 42. The actuator pin 22 of the actuator 20 is engaged with the first end 29 of the arm 28 so that an actuation force F1 imparted by the actuator pin 22 on the arm 28 causes downward movement of the arm 28 in the first direction D1. A second end 30 of the arm 28 is defined by a first finger 31A and a second finger 31B. The arm 28 could be described as having a second end 30 that splits into two fingers. The first and second fingers 31A, 31B engage opposite sides of the locking collar 70 of the switchable valve bridge 40. Therefore, when the arm 28 is forced downward in the first direction via the actuation force F1, this actuation force F1 is communicated to the locking collar 70 of the switchable valve bridge 40. The actuation force F1 overcomes: i) a force F2 imparted on the locking collar 70 (via the first and second ramps 80A, 80B) by the ramp return spring 86, and ii) a force F3 imparted on the arm 28 by the arm return spring 24 mounted on the bracket 26, so that the locking collar 70 moves downward in the first direction D1. The actuation force F1, as described herein and shown in the figures, is not derived from pressurized hydraulic fluid. Instead, the actuation force F1 is derived by electro-mechanical means or that of an electro-mechanical actuator. In other example embodiments, the locking collar 70 could be displaced hydraulically.

In order for the switchable valve bridge 40 to change or transition from the second unlocked position to the first locked position, the actuator pin 22 of the actuator 20 is electrically retracted so that the arm 28 moves upward (in the second direction D2) via the force F3 imparted on the arm 28 by the arm return spring 24 (FIG. 1); and the locking collar 70 and first and second ramps 80A, 80B move upward via the force F2 provided by the ramp return spring 86 (FIG. 13A). A lower end of the ramp return spring 86 engages a top of the spring collar 94 and an upper end of the ramp return spring 86 engages first and second bottom annular surfaces 88A, 88B of the respective first and second ramps 80A, 80B. The spring collar 94 and a lower end 58 of the extension 48 of the outer housing 42 can engage the cylinder head (not shown). In other example embodiments, the spring collar 94 could be eliminated and the spring could abut directly with the cylinder head or with a radial outcropping of the extension 48 of the outer housing 42.

As shown in FIGS. 10A, 10B, and 13B, the first and second ramps 80A, 80B are two separate components that are housed within a radially inwardly protruding step 71 of the locking collar 70. Each of the first and second ramps 80A, 80B have corresponding first and second arc-shaped bodies 82A, 82B that have first and second top annular surfaces 81A, 81B, first and second bottom annular surfaces 88A, 88B, and first and second protrusions 87A, 87B. The first and second protrusions 87A, 87B protrude radially inwardly from respective curved inner sides 83A, 83B of the arc-shaped bodies 82A, 82B. As evident from FIGS. 13A and 13B, the first and second ramps 80A, 80B are installed on the extension 48 of the outer housing 42 such that the first and second protrusions 87A, 87B extend into or are continuously disposed within respective first and second locking apertures 49A, 49B throughout the first locked and second unlocked positions. The first and second protrusions 87A, 87B have respective first and second tapered latch interfaces 84A, 84B that are tapered at an angle An1. The first and second tapered latch interfaces 84A, 84B can be sloped radially inwardly as they extend in the second direction D2; alternatively described, the first and second tapered latch interfaces 84A, 84B can be radially decreasing as they extend in the second direction D2. Movement of the first and second ramps 80A, 80B in the first direction D1 via the locking collar 70 causes the first and second tapered latch interfaces 84A, 84B to engage respective first and second outer ends 69A, 69B of the first and second locking latches 66A, 66B. Due to the previously described "radially decreasing" form of the first and second tapered latch interfaces 84A, 84B, further downward movement of the first and second ramps 80A, 80B causes the first and second locking latches 66A, 66B to move radially inwardly within the locking bore 62 to unlock the inner housing 60 from the outer housing 42. The first and second outer ends 69A, 69B of the first and second locking latches 66A, 66B can be curved, as shown in FIGS. 13A-13B, or any other suitable shape that interfaces with the first and second ramps 80A, 80B.

As previously described, the first and second protrusions 87A, 87B are continuously disposed within the respective first and second locking apertures 49A, 49B throughout the first locked and second unlocked positions. In the first locked position shown in FIG. 13A, the first and second protrusions 87A, 87B are located at an upper portion of the respective first and second locking apertures 49A, 49B. During a transition from the first locked position to the second unlocked position, the first and second protrusions 87A, 87B move downward in the first direction D1 within the respective first and second locking apertures 49A, 49B. Once the second locked position is achieved by the first and second ramps 80A, 80B (via the locking collar 70), the first and second protrusions 87A, 87B reside in a lower portion of the respective first and second locking apertures 49A, 49B, as shown in FIG. 13B.

A lost motion spring 32 is disposed axially between the inner housing 60 and an end of the bore 52 of the outer housing 42. It could be stated that the inner housing 60 and lost motion spring are arranged in series within the bore 52. Referring to FIG. 13A, the lost motion spring 32 applies a force F3 to an underside of the inner housing 60 so that the stepped ring interface 78 of the inner housing 60 forcibly engages the mechanical lash adjustment ring 36 that is retained within the bore 52 of the outer housing 42 by the inner housing retaining ring 34. When the switchable valve bridge 40 is in the second unlocked position, rotary motion of the camshaft 10 is translated to linear motion of the inner housing 60 within the bore 52 of the outer housing 42. Thus, as the camshaft 10 rotates, the inner housing 60 reciprocates up and down within the bore 52 along an actuation axis A2 of the inner housing, aided by the lost motion spring 32 that provides a return means for the inner housing 60 to its upper-most position within the bore. The actuation axis A2 is parallel to the first and second directions D1, D2.

Turning to FIG. 3, the mechanical lash adjustment ring 36 is selectively installed on the lash step 45 of the bore 52 of the outer housing 42. The mechanical lash adjustment ring 36 is selected from a plurality of lash adjustment ring groups that are categorized according to their thickness T. The mechanical lash adjustment ring 36 (and its corresponding thickness) controls an axial position of the inner housing 60 within the bore 52, or, more precisely, a mechanical lash L1 or gap between the first and second locking latches 66A, 66B and the corresponding first and second locking apertures 54A, 54B, as shown in FIG. 13A. The mechanical lash L1, and a tolerance thereof, is a design parameter of the switchable valve bridge 40 that can be specified by an IC engine manufacturer. In an example embodiment, the mechanical lash L1 is less than one millimeter. As known in the art, this mechanical lash L1 can correspond to an opening ramp of a camshaft lobe, such that the opening ramp is configured to gently seat the first and second locking latches 66A, 66B against the corresponding first and second locking apertures 54A, 54B of the outer housing 42 to avoid harsh impacts and resultant wear at this interface.

In an example embodiment of an assembly process, a mechanical lash adjustment ring 36 with a known thickness (a "gage ring") can be installed together with the inner housing retaining ring 34 that snaps into the retaining groove 43. Mechanical lash of the switchable valve bridge 40 can then be measured; from this lash measurement, a proper mechanical lash adjustment ring 36 (based on its thickness T) can be selected that achieves a mechanical lash that falls within the pre-determined mechanical lash design range for the switchable valve bridge 40. A thickness of the selected mechanical lash adjustment ring 36 may be equal to, less than, or greater than the thickness of the gage ring.

Other suitable mechanical lash adjusters 38 could also be applied to the switchable valve bridge 40 other than what is previously described and shown in the figures.

In the previously described example embodiments, the inner housing 60 slidably moves downward in the first direction D1 within the bore 52 of the outer housing 42 while the switchable valve bridge 40 is in the second unlocked position. This could be described as a telescoping action of the inner housing 60 relative to the outer housing 42. A magnitude of displacement of the inner housing 60 relative to the outer housing 42 is often referred to as a lost motion stroke. A magnitude of the lost motion stroke can be at least as great as a valve lift of the poppet valves 16 during the first locked position of the switchable valve bridge 40. In such an instance, the second unlocked position will yield a no-valve-lift or zero-valve-lift condition of the poppet valves 16, which is often referred to as valve deactivation.

In a further example embodiment, the lost motion stroke can be less than the valve lift of the poppet valves 16 that is present during the first locked position so that a small amount of valve lift of the poppet valves 16 is possible while in the second unlocked position. Therefore, the switchable valve bridge 40 could facilitate two different non-zero-valve-lift opening magnitudes as a product of the respective first locked and second unlocked positions. For example, the first locked position could yield a full or standard valve lift of the poppet valves 16 (as with the previous valve deactivation example), and the second unlocked position could yield a partial valve lift that is greater than zero but less than the full valve lift. This could be achieved by limiting the lost motion stroke of the inner housing 60 by incorporating an end stop for the inner housing 60 within the bore 52 of the outer housing 42. Other suitable means for limiting the lost motion stroke are also possible. Unlike traditional cam profile switching valve train systems, the two different non-zero-valve lifts achieved via the first locked and second unlocked positions could be achieved with a single camshaft lobe.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. As such, to the extent any embodiments are described as less desirable than other embodiments or prior art implementations with respect to one or more characteristics, these embodiments are not outside the scope of the disclosure and can be desirable for particular applications.

What is claimed is:

1. A switchable valve bridge for an internal combustion engine, the switchable valve bridge comprising:

an outer housing having:

a first valve pallet configured to interface with a first poppet valve;

a second valve pallet configured to interface with a second poppet valve;

a first locking aperture; and a second locking aperture; and an inner housing slidably disposed within the outer housing, the inner housing having: i) a first locking latch configured to move radially relative to an actuation axis of the inner housing, and ii) a second locking latch configured to move radially relative to the actuation axis of the inner housing;

a locking collar configured to move axially via an actuation force applied to the locking collar in a first axial direction;

a first ramp disposed within the first locking aperture and configured to be actuated by the locking collar such that axial movement of the first ramp causes radial movement of the first locking latch, the first ramp configured to directly engage the first locking latch;

a second ramp disposed within the second locking aperture and configured to be actuated by the locking collar such that axial movement of the second ramp causes radial movement of the second locking latch, the second ramp configured to directly engage the second locking latch; and a first locked position with the first locking latch engaging the first locking aperture and the second locking latch engaging the second locking aperture so that the inner housing is locked to the outer housing; and a second unlocked position with the first locking latch and the second locking latch in a radially inward position so that the inner housing is unlocked from the outer housing.

2. The switchable valve bridge of claim 1, wherein the first ramp includes a tapered interface configured to engage the first locking latch.

3. The switchable valve bridge of claim 2, wherein the tapered interface engages a curved surface of the first locking latch.

4. The switchable valve bridge of claim 1, further comprising a mechanical lash adjustment ring arranged between the inner housing and the outer housing, the mechanical lash adjustment ring configured to be selectively installed to adjust an axial position of the inner housing relative to the outer housing.

5. The switchable valve bridge of claim 1, further comprising a return spring configured to move the locking collar in a second axial direction when the actuation force is less than a force of the return spring.

6. The switchable valve bridge of claim 1, further comprising a lost motion spring arranged between the inner housing and the outer housing.

7. The switchable valve bridge of claim 6, wherein the outer housing is configured with a bore that extends along the actuation axis, and the inner housing and the lost motion spring are arranged in series within the bore.

8. The switchable valve bridge of claim 7, wherein the inner housing includes a protrusion that protrudes outside of the bore of the outer housing, and the protrusion includes a rocker arm interface configured to directly engage a rocker arm.

9. The switchable valve bridge of claim 1, wherein the first ramp and the locking collar move axially together in unison.

10. The switchable valve bridge of claim 1, wherein the first ramp and the second ramp are separate components.

11. The switchable valve bridge of claim 1, wherein the actuation force is not derived from a pressurized hydraulic fluid.

12. A switchable valve bridge for an internal combustion engine, the switchable valve bridge comprising:

an outer housing configured to actuate two poppet valves, the outer housing having an extension comprising:

an inner surface defining a bore;

an outer surface arranged radially outwardly of the inner surface; and a locking aperture;

an inner housing slidably disposed within the bore of the extension, the inner housing having a locking latch configured to move radially relative to an actuation axis of the inner housing;

a locking collar configured to: i) move axially via an actuation force applied to the locking collar in a first direction, and ii) be slidably guided by the outer surface of the extension; and a ramp disposed within the locking collar and the locking aperture, the ramp configured to be actuated by the locking collar such that axial movement of the ramp within the locking aperture causes radial movement of the locking latch from a first locked position, in which the locking latch engages the locking aperture, to a second unlocked position, in which the inner housing is unlocked from the outer housing.

13. The switchable valve bridge of claim 12, further comprising a lash adjustment ring arranged within the bore, the lash adjustment ring selected from one of a plurality of lash adjustment ring groups to achieve a predetermined mechanical lash between the inner housing and the outer housing, the plurality of lash adjustment ring groups sorted according to thickness.

14. The switchable valve bridge of claim 12, wherein the locking latch comprises a flat configured to engage a flat of the locking aperture in the first locked position.

15. The switchable valve bridge of claim 12, further comprising a lost motion spring arranged within the bore of the extension.

16. The switchable valve bridge of claim 15, further comprising a return spring arranged to engage at least one of the ramp or the locking collar, the return spring configured to move the ramp and the locking collar in a second axial direction when the actuation force is less than a force of the return spring.

17. A switchable valve bridge system for an internal combustion engine, the switchable valve bridge system comprising:

an electrical actuator;

an arm configured to be actuated by the electrical actuator;

a switchable valve bridge comprising:

an outer housing configured to actuate two poppet valves, the outer housing having an extension including a locking aperture;

an inner housing slidably disposed within a bore of the outer housing, the inner housing having a locking latch configured to move radially relative to an actuation axis of the inner housing; and a locking collar:

arranged radially outwardly of the inner housing;

engaged with the arm;

configured to move axially via an actuation force from the arm via the electrical actuator; and having a ramp configured to engage the locking latch so as to move the locking latch in a radial direction from a first locked position, in which the locking latch engages the locking aperture, to a second unlocked position, in which the inner housing is unlocked from the outer housing.

18. The switchable valve bridge system of claim 17, wherein the arm includes two fingers that extend on opposites sides of the outer housing and engage the locking collar.

19. The switchable valve bridge system of claim 17, further comprising a mechanical lash adjuster configured to adjust an axial position of the inner housing within the bore to selectively adjust a mechanical lash between the inner housing and the outer housing.

* * * * *